US012313369B2

(12) United States Patent
Howell et al.

(10) Patent No.: US 12,313,369 B2
(45) Date of Patent: May 27, 2025

(54) MODULARIZED PLATFORM FOR MUNITION CANISTER

(71) Applicants: James E. Howell, Fredericksburg, VA (US); Matthew James O'Neill, Fredericksburg, VA (US); Jonathan F. Pfab, Richmond, VA (US); Vernon Todd Davis, King George, VA (US); Vincent J. Vendetti, King George, VA (US); Carl S. Lynn, IV, Fredericksburg, VA (US)

(72) Inventors: James E. Howell, Fredericksburg, VA (US); Matthew James O'Neill, Fredericksburg, VA (US); Jonathan F. Pfab, Richmond, VA (US); Vernon Todd Davis, King George, VA (US); Vincent J. Vendetti, King George, VA (US); Carl S. Lynn, IV, Fredericksburg, VA (US)

(73) Assignee: United States of America, as represented by the Secretary of the Navy, Arlington, VA (US)

( * ) Notice: Subject to any disclaimer, the term of this patent is extended or adjusted under 35 U.S.C. 154(b) by 523 days.

(21) Appl. No.: 17/942,719

(22) Filed: Sep. 12, 2022

(65) Prior Publication Data

US 2024/0085131 A1 Mar. 14, 2024

(51) Int. Cl.
*F41A 9/87* (2006.01)

(52) U.S. Cl.
CPC ..... *F41A 9/87* (2013.01)

(58) Field of Classification Search
CPC ..... F42B 39/22; F41A 9/87; F41F 3/042
USPC ..... 89/37.01, 37.11, 37.13
See application file for complete search history.

(56) References Cited

U.S. PATENT DOCUMENTS 4,655,668 A * 4/1987 Perisastry ..... F42B 39/22 206/443
7,854,189 B1 * 12/2010 Fox ..... F41F 3/04 89/1.804
2004/0069136 A1 * 4/2004 Smith ..... F41F 3/0406 89/1.815
2004/0081526 A1 * 4/2004 Hoeper ..... F41A 9/87 410/42
2005/0135895 A1 * 6/2005 Valentine ..... F41A 9/87 410/50
2009/0104839 A1 * 4/2009 Chang ..... A63H 27/005 446/212

(Continued)

FOREIGN PATENT DOCUMENTS

CN 112710201 A * 4/2021 ..... F42B 39/22

*Primary Examiner* — Bret Hayes
(74) *Attorney, Agent, or Firm* — Gerhard W. Thielman

(57) ABSTRACT

A mounting platform is provided for securing munitions. The platform includes a flat plate, a front block and a rear block. The plate includes a plurality of cutout holes. The front block has a first saddle disposed between first flanking ends and at least one extension at one of the flanking ends for inserting into a first opening of the cutouts. The rear block has a second saddle disposed between second flanking ends at least one extension for inserting into a second opening of the cutouts. The munitions are disposable atop the first and second saddles of the front and rear blocks. The munitions are restrained axially against a rear stop block and laterally by the saddles and straps.

10 Claims, 10 Drawing Sheets

(56) References Cited

U.S. PATENT DOCUMENTS

| | | | | |
|---|---|---|---|---|
| 2019/0017794 | A1* | 1/2019 | Kingery | B60R 9/055 |
| 2021/0190452 | A1* | 6/2021 | Jeannot | F41A 23/20 |
| 2022/0041416 | A1* | 2/2022 | Viola | B60P 9/00 |
| 2022/0090896 | A1* | 3/2022 | Mansell | F42B 39/26 |

* cited by examiner

300

200

MODULARIZED PLATFORM FOR MUNITION CANISTER

STATEMENT OF GOVERNMENT INTEREST

The invention described was made in the performance of official duties by one or more employees of the Department of the Navy, and thus, the invention herein may be manufactured, used or licensed by or for the Government of the United States of America for governmental purposes without the payment of any royalties thereon or therefor.

BACKGROUND

The invention relates generally to platforms for canister munitions. In particular, the invention relates to modular equipment to interchangeably secure containerized ordnance for aerial deployment or transport.

SUMMARY

Conventional mounting interfaces for containerized munitions yield disadvantages addressed by various exemplary embodiments of the present invention. In particular, various exemplary embodiments provide a mounting platform for securing munitions. The platform includes a flat plate, a front block and a rear block. The plate includes a plurality of cutouts. The front block has a first saddle disposed between first flanking ends and at least one flange at one of the flanking ends for inserting into a first opening of the cutouts. The rear block has a second saddle disposed between second flanking ends at least one pad for inserting into a second opening of the cutouts. The munitions are disposable atop the first and second saddles of the front and rear blocks.

BRIEF DESCRIPTION OF THE DRAWINGS

These and various other features and aspects of various exemplary embodiments will be readily understood with reference to the following detailed description taken in conjunction with the accompanying drawings, in which like or similar numbers are used throughout, and in which.

DETAILED DESCRIPTION

In the following detailed description of exemplary embodiments of the invention, reference is made to the accompanying drawings that form a part hereof, and in which is shown by way of illustration specific exemplary embodiments in which the invention may be practiced. These embodiments are described in sufficient detail to enable those skilled in the art to practice the invention. Other embodiments may be utilized, and logical, mechanical, and other changes may be made without departing from the spirit or scope of the present invention. The following detailed description is, therefore, not to be taken in a limiting sense, and the scope of the present invention is defined only by the appended claims.

The disclosure generally employs quantity units with the following abbreviations: length in inches (in), mass in pounds ($lb_m$), time in seconds (s) and angles in degrees (°). Supplemental measures can be derived from these, such as density in pounds-per-cubic-inch ($lb_m/in^3$), and the like. The purpose of the modular block and mounting plate is to define a common mounting interface for canisterized munitions with varying diameters and lengths designed for quick installation and adjustment.

Conventionally, the only way to launch a canisterized munition from a platform is to use the vendor's launcher, which is exclusive to its own specific munitions. The goal of the exemplary modular block design is to accommodate any munition from the leading suppliers and establish a common mounting interface. Exemplary embodiments provide a modular assembly for attaching canisterized munitions with minimal components in various configurations, including for aerial deployment, loiter and transport.

Figure 1:
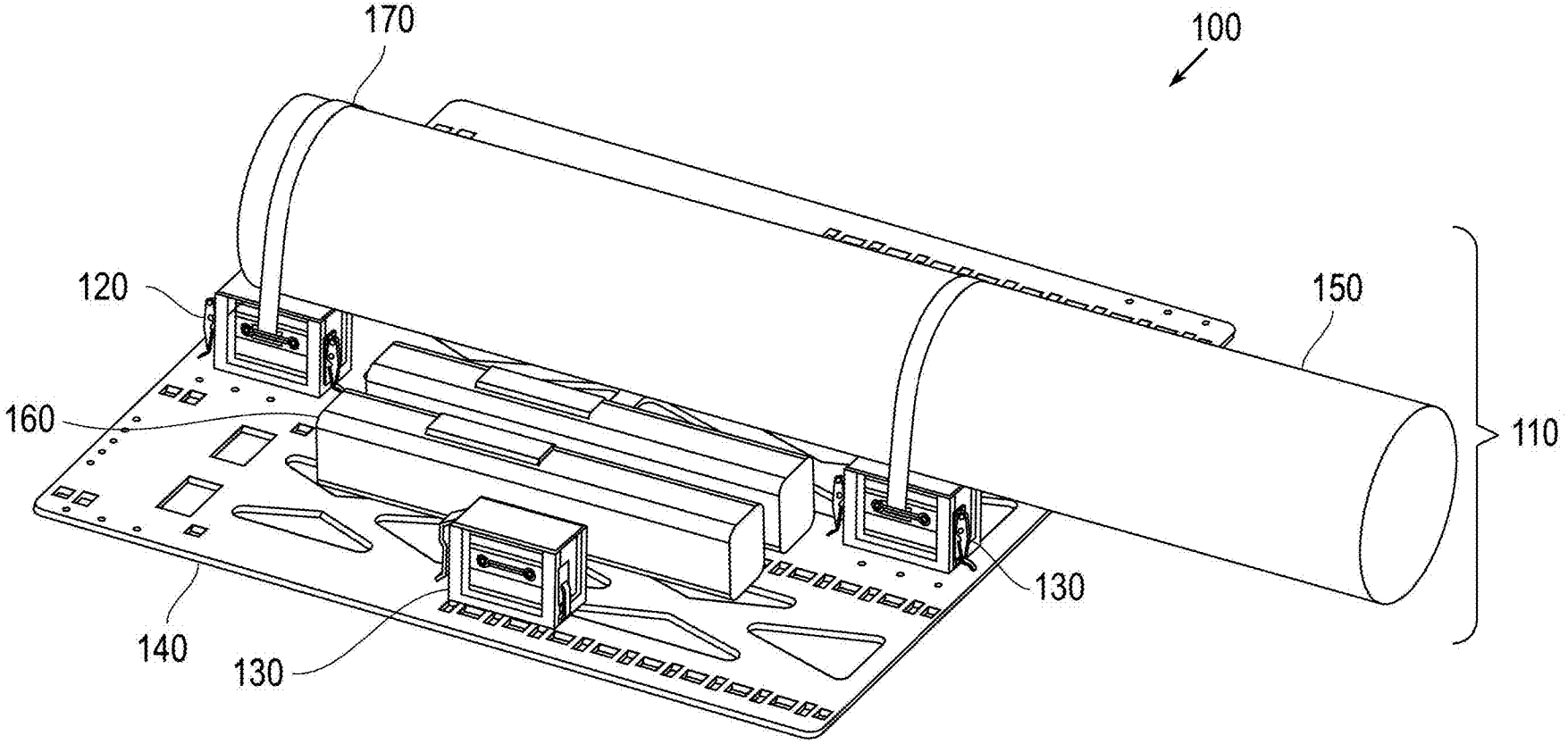
FIG. 1 is a perspective view of a modular ordinance assembly.

FIG. 1 shows a perspective view 100 of an exemplary munitions assembly 110. This includes a rear modular block 120, a front modular block 130 and a mounting plate 140 onto which the blocks 120 and 130 attach. These are intended to secure Echelon-2 canisterized munitions 150 with retaining straps 170. The front modular block 130 can be inverted to accept Echelon-1 munitions 160 using either a Picatinny rail mount adapter or utilizing the flat surface of the flat attach plate 140 and the retaining strap 170. Note that the latches are steel, while all other components are aluminum.

Figure 2A:
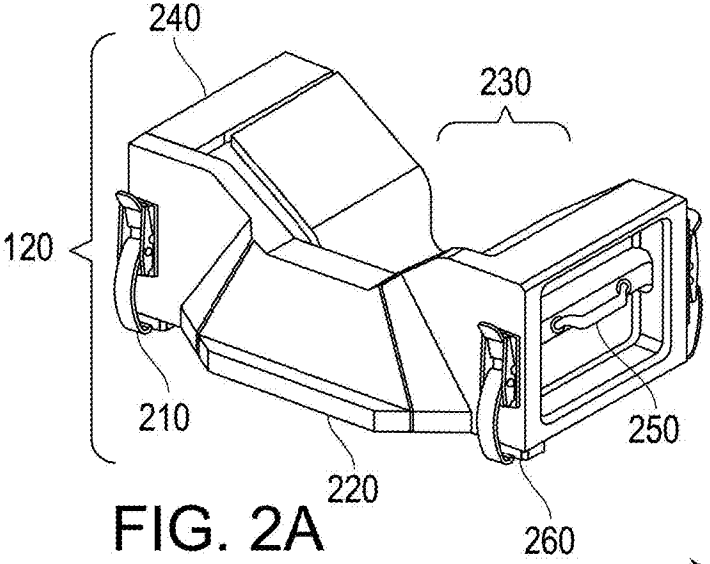
FIG. 2A is a perspective view of a rear block.
Figure 2B:
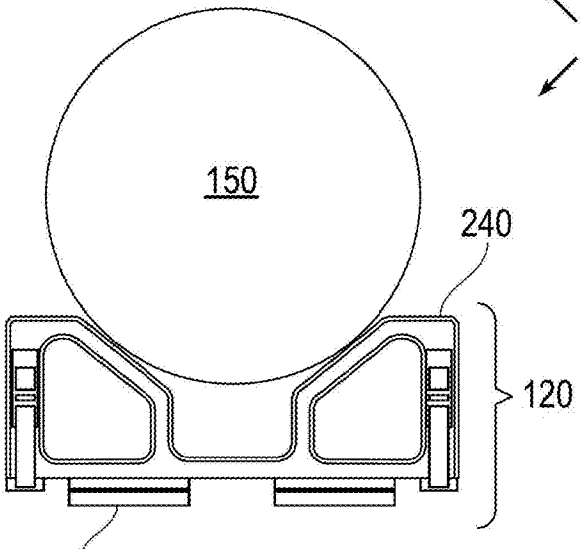
FIG. 2B is an elevation view of the rear block with an Echelon-2 munition.

FIGS. 2A and 2B show perspective and elevation views 200 respectively of the rear modular block 120. This includes four downward-facing latches 210 at the corners and a foot 220 that serves as a backstop for a V-shape saddle 230 flanked by rectangular ends 240. A pair of handles 250 attach to the distal sides of the ends 240, which mount the retaining straps 170. The rear modular block 120 also includes an insert tang 260 and hook pad 270 on the underside. The munition 150 is disposed within the saddle 230. The backstop foot 220 absorbs recoil from launch of the munition 150.

Figure 3A:
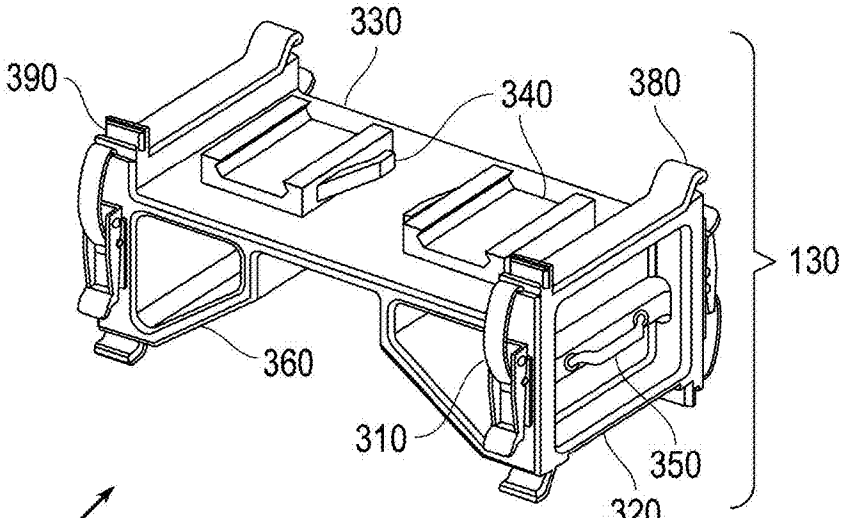
FIG. 3A is a perspective view of a front block.
Figure 3B:
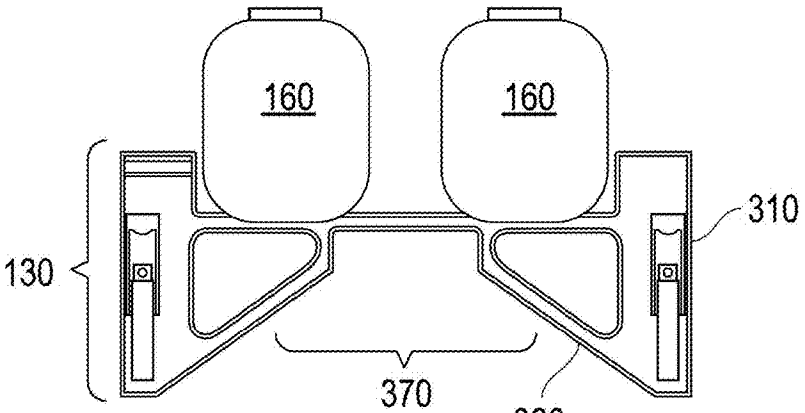
FIG. 3B is an elevation view of the front block with two Echelon-1 munitions.

FIGS. 3A and 3B show perspective and elevation views 300 respectively of the front modular block 130. This includes two upward-facing and two downward-facing latches 310 located at rectangular ends 320 connected by a bridge 330. A pair of Picatinny rails 340 are disposed on the bridge 330. A pair of handles 350 attach to the distal sides of the ends 320, on which mount the retaining straps 170. Support buttresses 360 extending from the ends 320 to support the bridge 330 form a V-shape saddle 370. Each end 320 also includes a curve flange 380 and a normal tang 390. The munition 160 is disposed within the saddle 370.

Figure 4B:
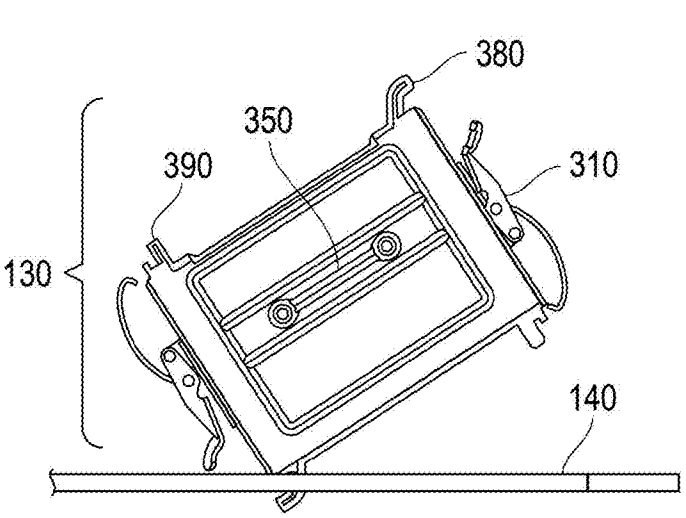
FIGS. 4A and 4B are elevation views of the front block.
Figure 4A:
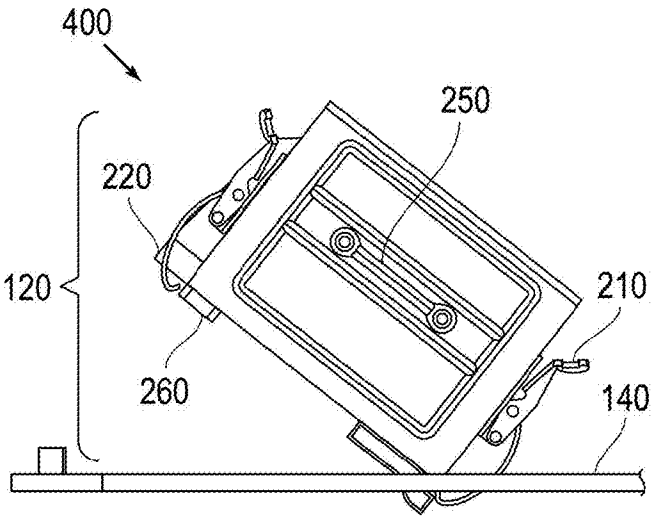

FIGS. 4A and 4B show respective elevation views 300 of the front and rear modular blocks 130 and 120, in conjunction with the mounting plate 140. The tang 380 can be inserted into the mounting plate 140 and secured by the latch 310. For the respective blocks 130 and 120 oriented at an oblique angle, the pad 270 and flange 380 hook into cavities of the plate 140. The blocks 130 and 120 then rotate to be flush with the plate 140, inserting their respective tangs 260 and 390 into adjacent cavities of the plate 140. The latches 210 and 310 can be replaced by alternate devices for securing the blocks 130 and 120 to the platform 140.

Figure 5:
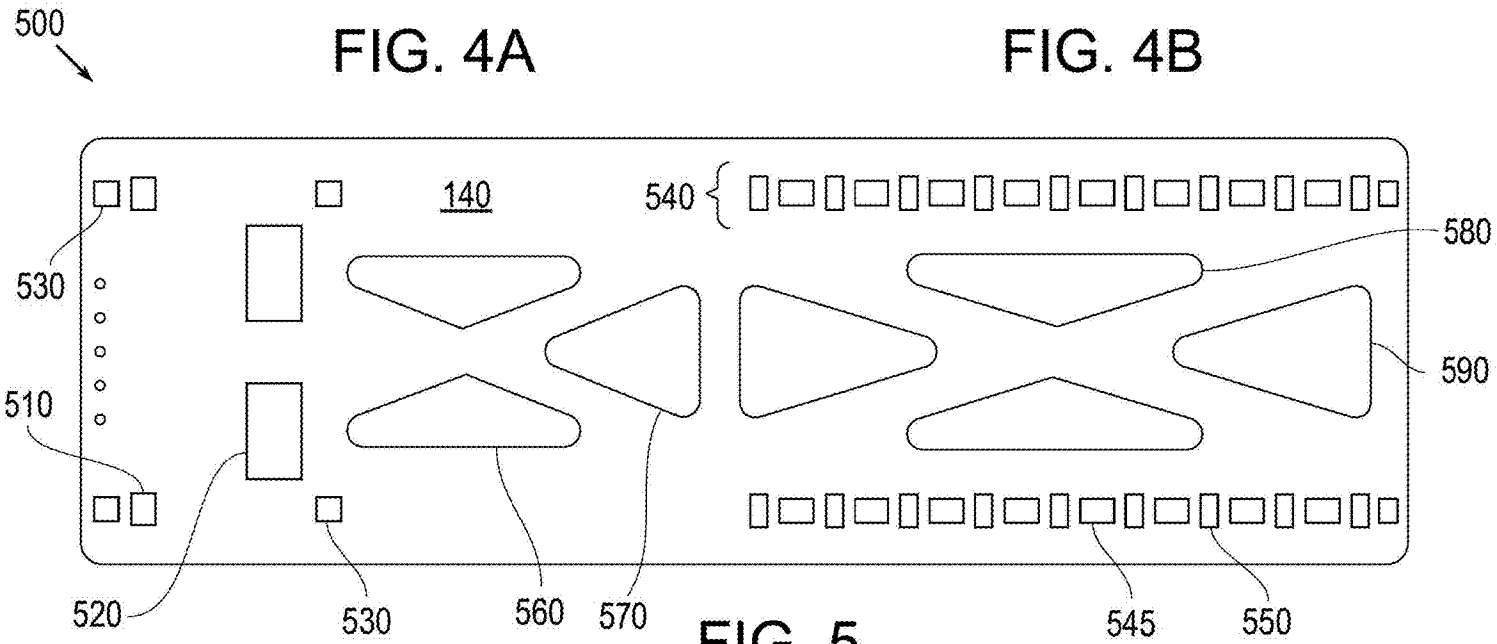
FIG. 5 is a plan view of a mounting plate with cutouts.

FIG. 5 shows a plan view 500 of the aluminum flat attach plate 140 with a series of cavities penetrating therethrough. These cavities include interspersed rectangular holes 510, 520 and 530, as well as a pair of concatenated rows 540 of alternating rectangular holes 545 and 550. The mounting plate 140 also includes more centrally disposed rounded triangle holes 560, 570, 580 and 590 to reduce the plate's mass. Holes 520 receive the pads 270, while holes 510 receive the tangs 260 on the rear block 120. Holes 550 accept the flanges 380 and tangs 390 on the front block 130. Holes 530 and 545 provide clearance for the latches 210 and 310. The holes can be produced by a variety of conventional methods.

Figure 6:
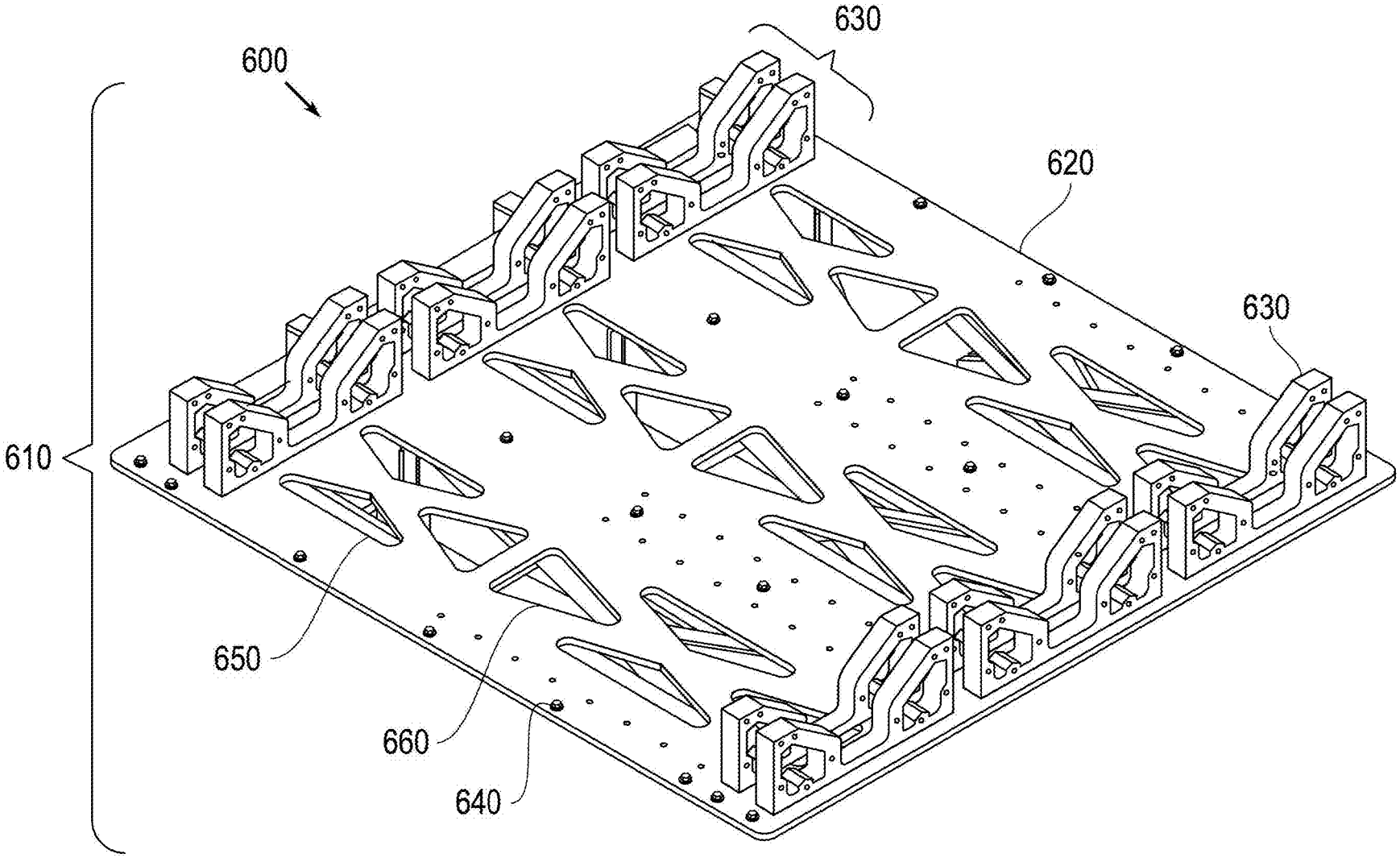
FIG. 6 is a perspective view of an alternative mounting plate with saddle flanges.

FIG. 6 shows perspective view 600 of another configuration 610 with an alternative mounting plate 620 with V-shape saddle blocks 630. The plate 620 includes peripheral through holes 640 for receiving attachment bolts, as well as lightening holes 650 and 660.

Figure 7:
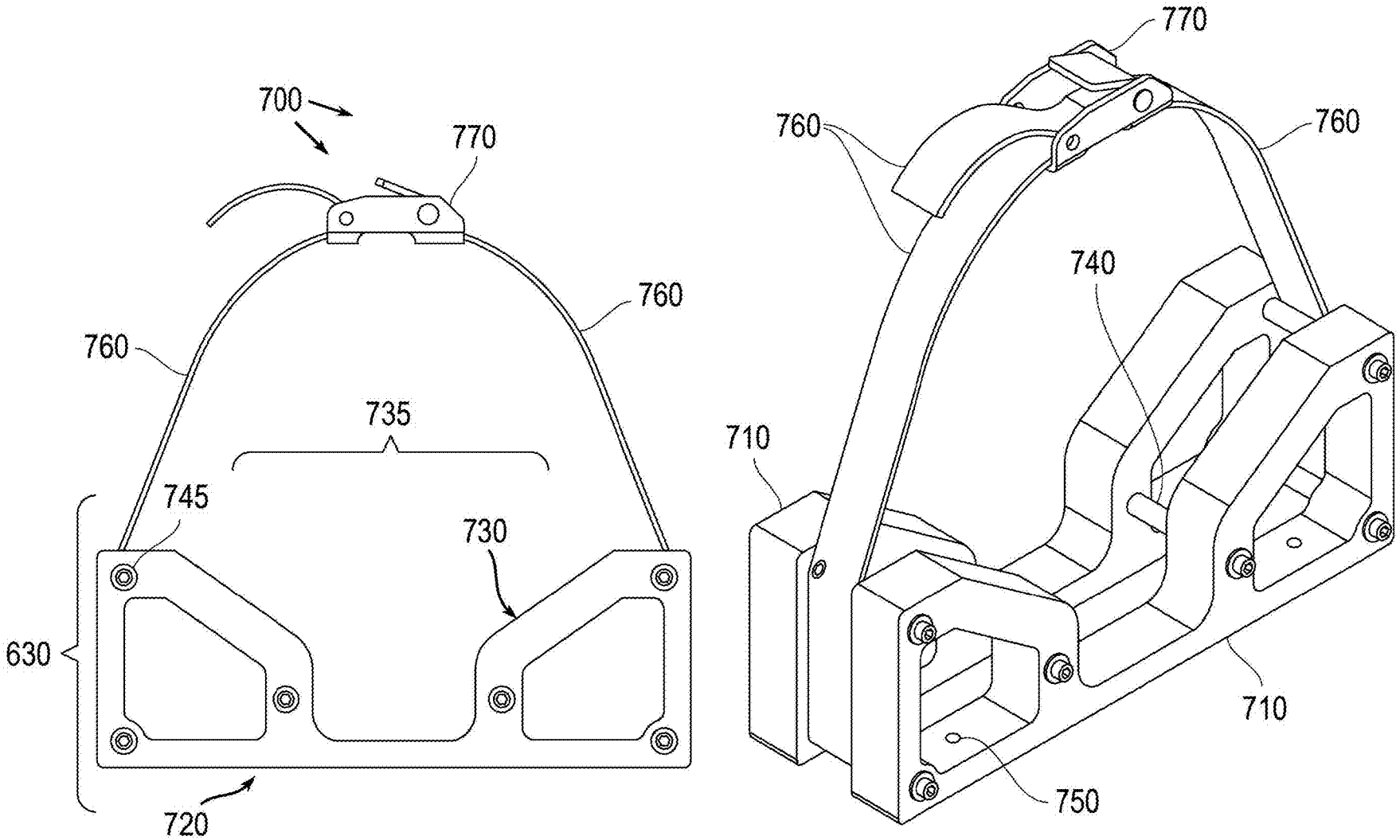
FIG. 7 is elevation and isometric views of a modular saddle block.

FIG. 7 shows elevation and isometric views 700 of an exemplary modular saddle block 630. These include saddle flanges 710 that exhibit dual bilateral symmetry—front-to-back and side-to-side. Each flange 710 includes a bottom surface 720 that engages the plate 620, as well as a bearing surface 730 that forms a V-shape saddle 735. The flanges 710 are disposed in tandem pairs held together by brace rods 740 that extend through collinear holes in the paired flanges 710, ending in bolt heads 745.

Holes 750 along the bottom of the flanges 710 enable bolts to be inserted to secure the surface 720 to the plate 620. The block 630 further includes a strap 760 that ends around the outer rods 740 for securing a canister. A hinged clamp 770 cinches the strap 760 in position. The configuration shown includes a pair of flanges 710 joined by rods 740, but this configuration can be expanded to a larger plurality of concatenated flanges 710 in tandem for less concentrated weight distribution.

The exemplary design comprises four components including the rear modular block 120, the front modular block 130 and the mounting plate 140, or alternatively the flanges 630 and the wider mounting plate 620. The front and rear modular blocks 130 and 120 each have a V-shape opening as 370 and 230 respectively that accept Echelon-2 munitions 150 with ranging diameters which are then tied down with the retaining strap 170. The front modular block 130 can be flipped over to accept Echelon-1 munitions 160 using either a Picatinny rail mount adapter 340 or utilizing the flat bridge 330 and retaining strap 170. Alternatively or additionally, generic modular blocks 630 can be similarly employed to provide V-shape saddles 735 to accept a variety of munitions.

The mounting plate 140 includes cutouts 510, 520, 530, 545 and 550 that accept mounting flanges 380 in the front modular blocks 130. For the rear modular block 120, the cutout is isolated to the back of the mounting plate 140, and there is only one corresponding location per Echelon-2 munition 150. For the front modular block 130, the mounting plate 140 has a patterned cutout that facilitates adjustment fore and aft to accommodate munitions of different lengths.

To install the front modular block 130, the bottom pads 270 are disposed into the designated cutouts 520 in the mounting plate 140 at an oblique angle. Then the rear modular block 120 is pivoted down to lie flat on the mounting plate 140 where the bottom feet 260 fall into their designated cutouts 510. The block 130 is then pressed back against the rear block 120 and is locked in place by securing the four latches 210 that drop into their respective cutouts 530.

Installing the front modular block 130 denotes a similar process. The curved flange 380 is dropped at an angle into a pair of its several evenly spaced cutouts row 540 in the mounting plate 140 based on the length of the desired munition 150. The front block 130 is then rotated down to lie flat on the mounting plate 140 where the bottom tangs 390 fall into their respective row of cutouts 540. The front block 130 is then locked down by securing the two downward facing latches 310 into the cutouts under the row 540.

To mount the front modular block 130 upside down for attaching Echelon-1 munitions 160, the same procedure is employed, but utilizing the latches 310 on the opposite face. The tangs 390 have lips that enable the unused latches 310 to secure to and prevent nuisance rattling. The mounting plate 140 can be easily scaled to accept larger canisterized munitions if necessary. Employing the same cutout design, the mounting plate 140 can become longer and provide even more flexibility.

The advantage to the exemplary modular block design utilized in the common launcher is its ability to effectively mount varying sized canisterized munitions. A range of munitions can be locked into position to safely resist the largest launch loads seen in Echelon-2 munitions 150 currently on the market.

Figure 8A:
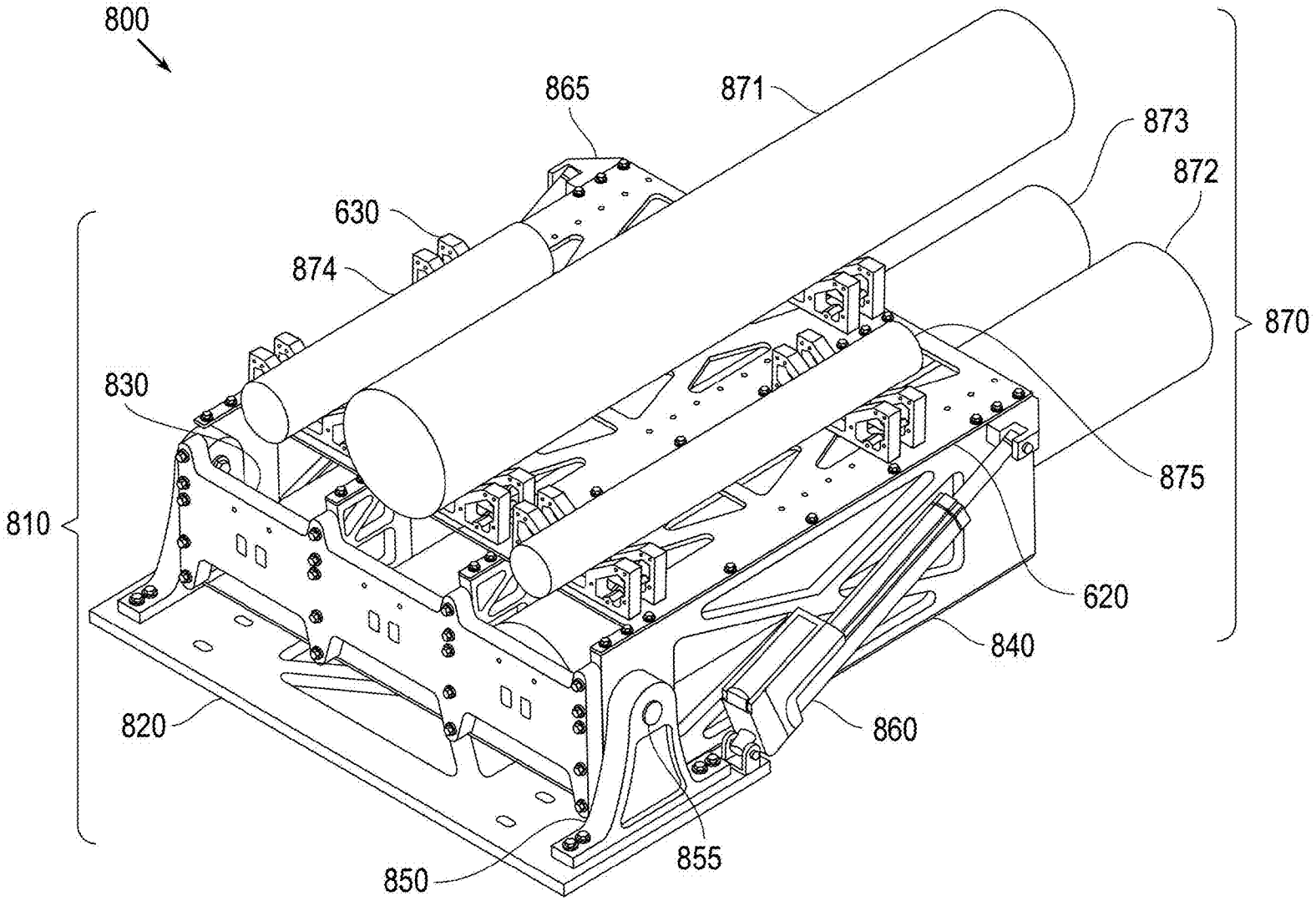
FIGS. 8A, 8B and 8C are perspective views of a multiple-missile assembly.
Figure 8B:
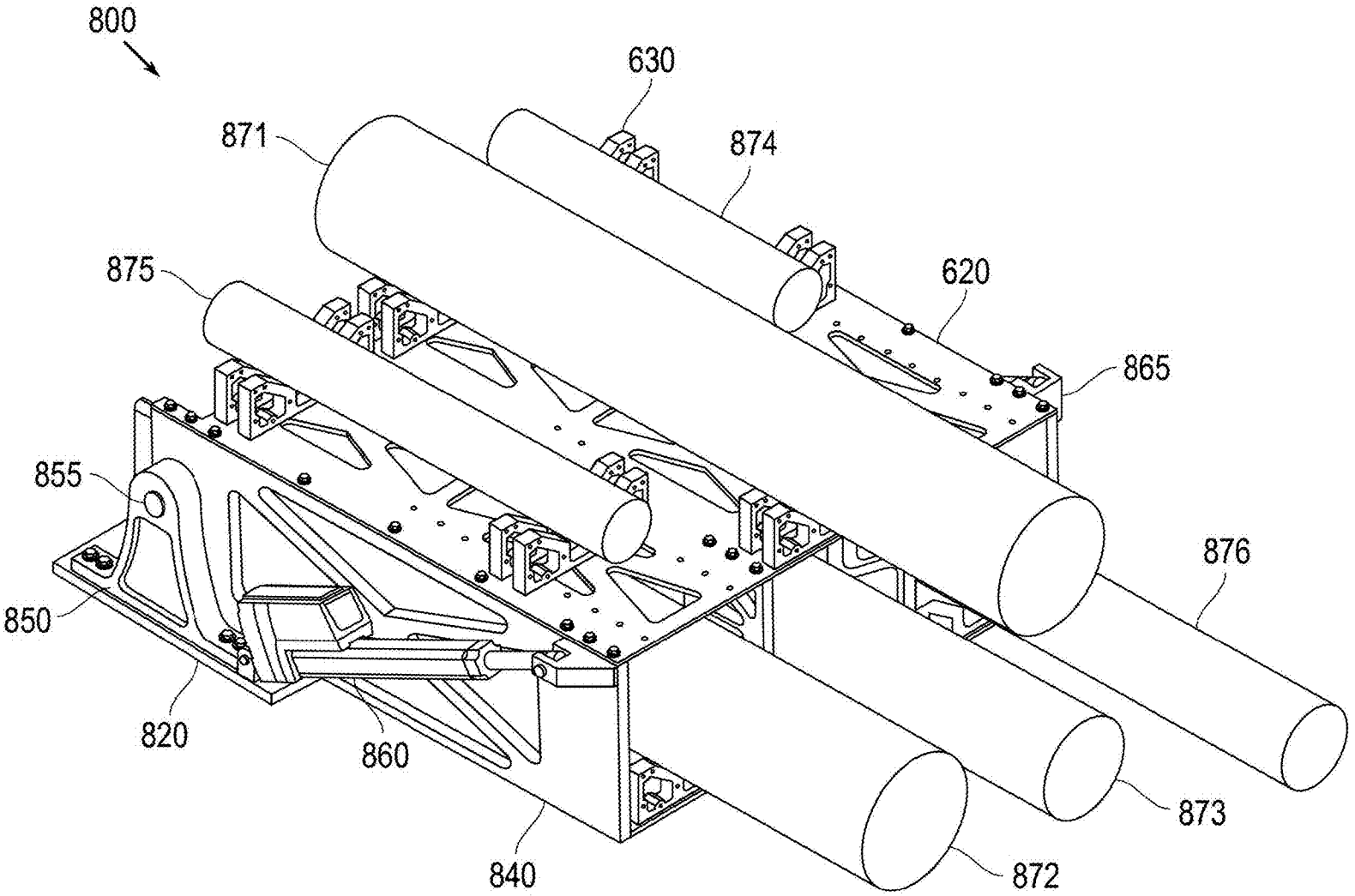
Figure 8C:
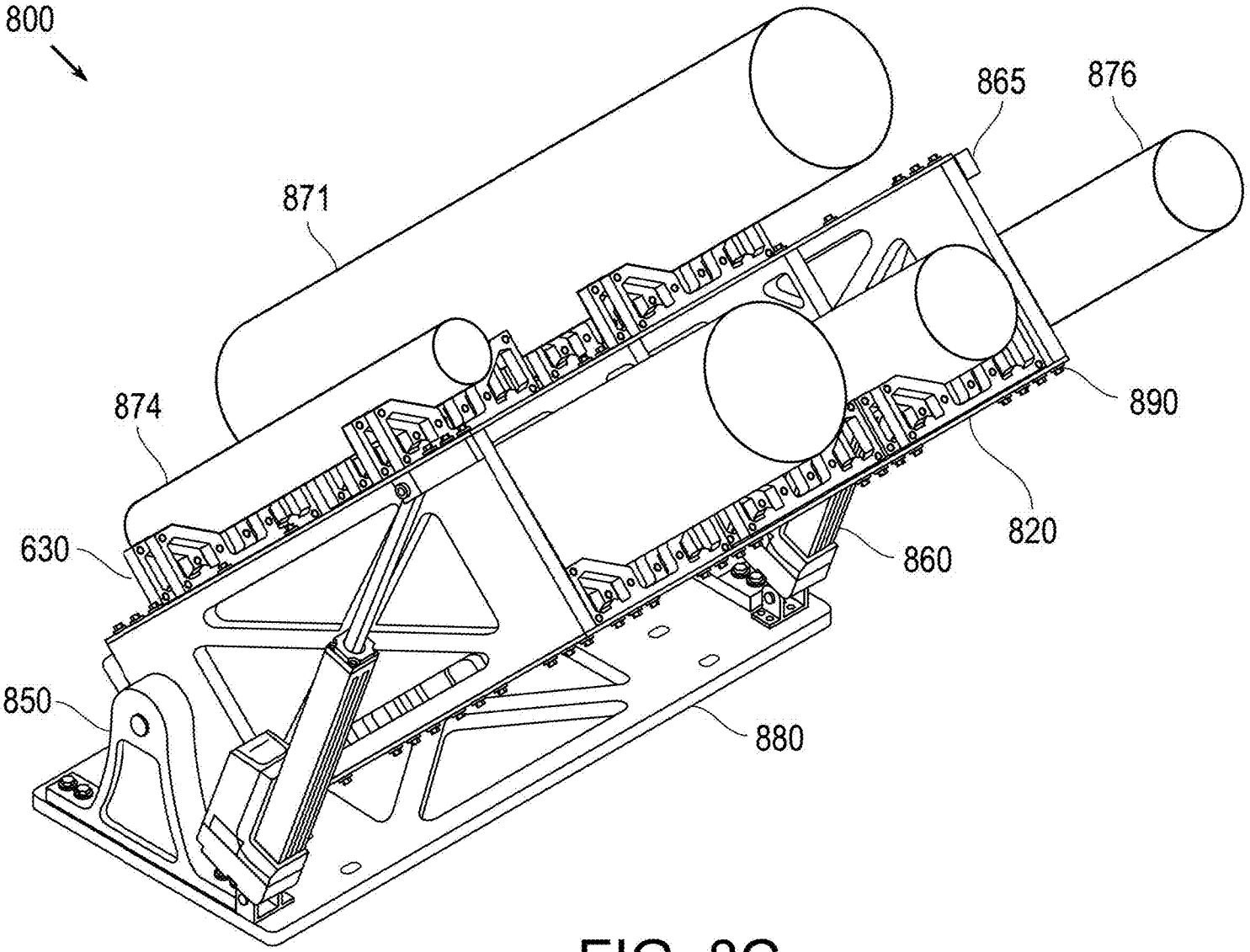

FIGS. 8A, 8B and 8C show perspective views 800 of a multiple-missile weapons assembly with an elevation assembly 810. A C-shape platform 820 provides a base onto which a backstop 830 is supported by a canister box 840 with mounting plates 620 attached above and below. The box 840 pivots on a pair of struts 850 along shaft hinges 855. The forward end of the box 840 can be raised or lowered by a pair of flanking actuators 860 that attach to the box 840 at joints 865.

The mounting plates 620 include V-shape supports 630 that resemble a shortened version of the front block 130 and featured in detail in view 700. A variety of missiles 870 can be supported by the assembly 810, identified as 871, 872, 873, 874, 875 and 876 in approximate sequential decrease by size.

In these examples, the box 840 contains missiles 872, 873 and 876, while the upper plate 620 supports missiles 871, 874 and 875. For purposes of scale, an example distance between the actuator 870 and a line parallel to the hinge 855 is slightly more than one foot. FIG. 8C further includes an alternative platform 880 for securing the struts 850 and the actuators 860, and further identifies bolts 890 that insert into the holes 640 for securing the plate 620 to the box 840.

Figure 9:
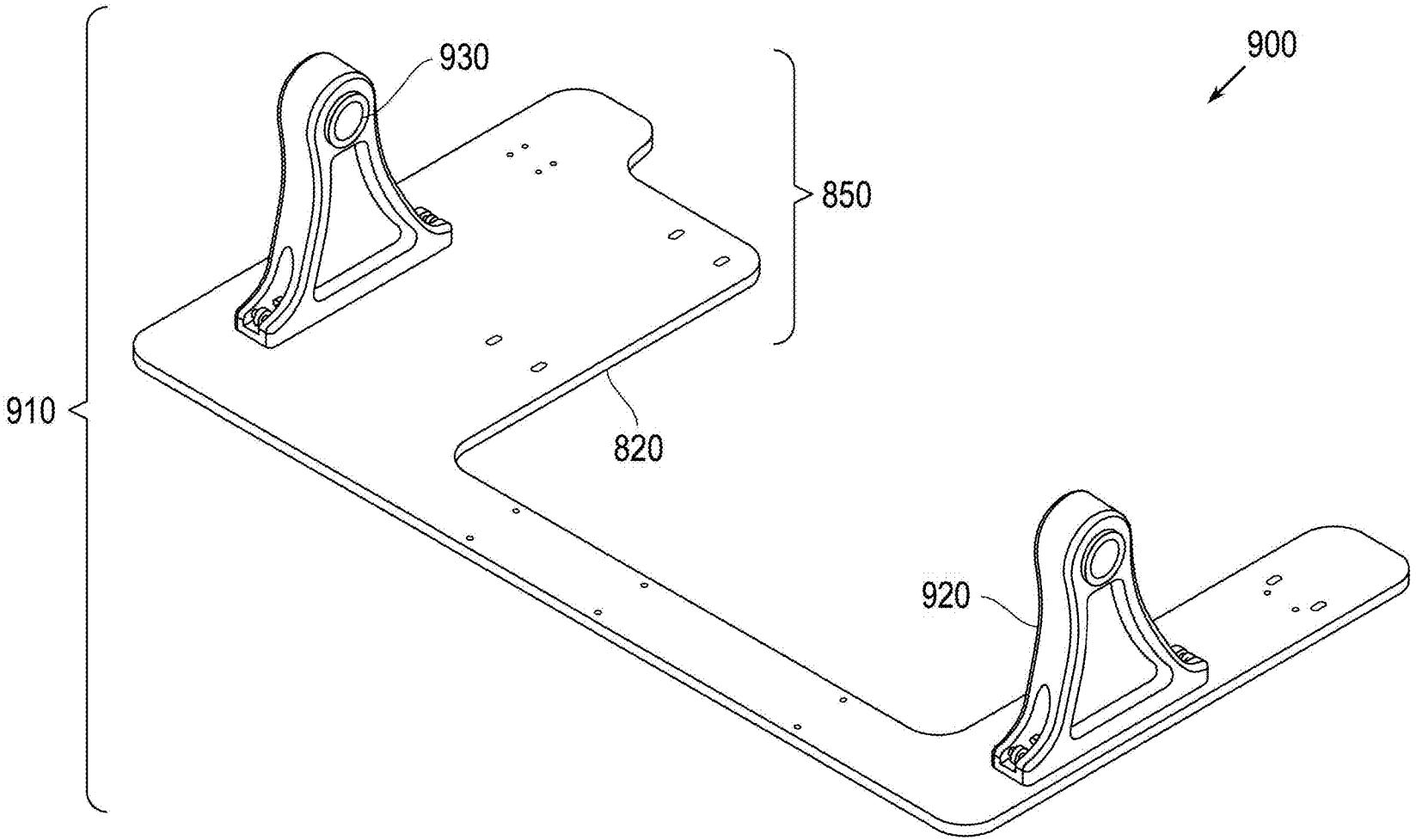
FIG. 9 is a perspective view of a platform.
Figure 10:
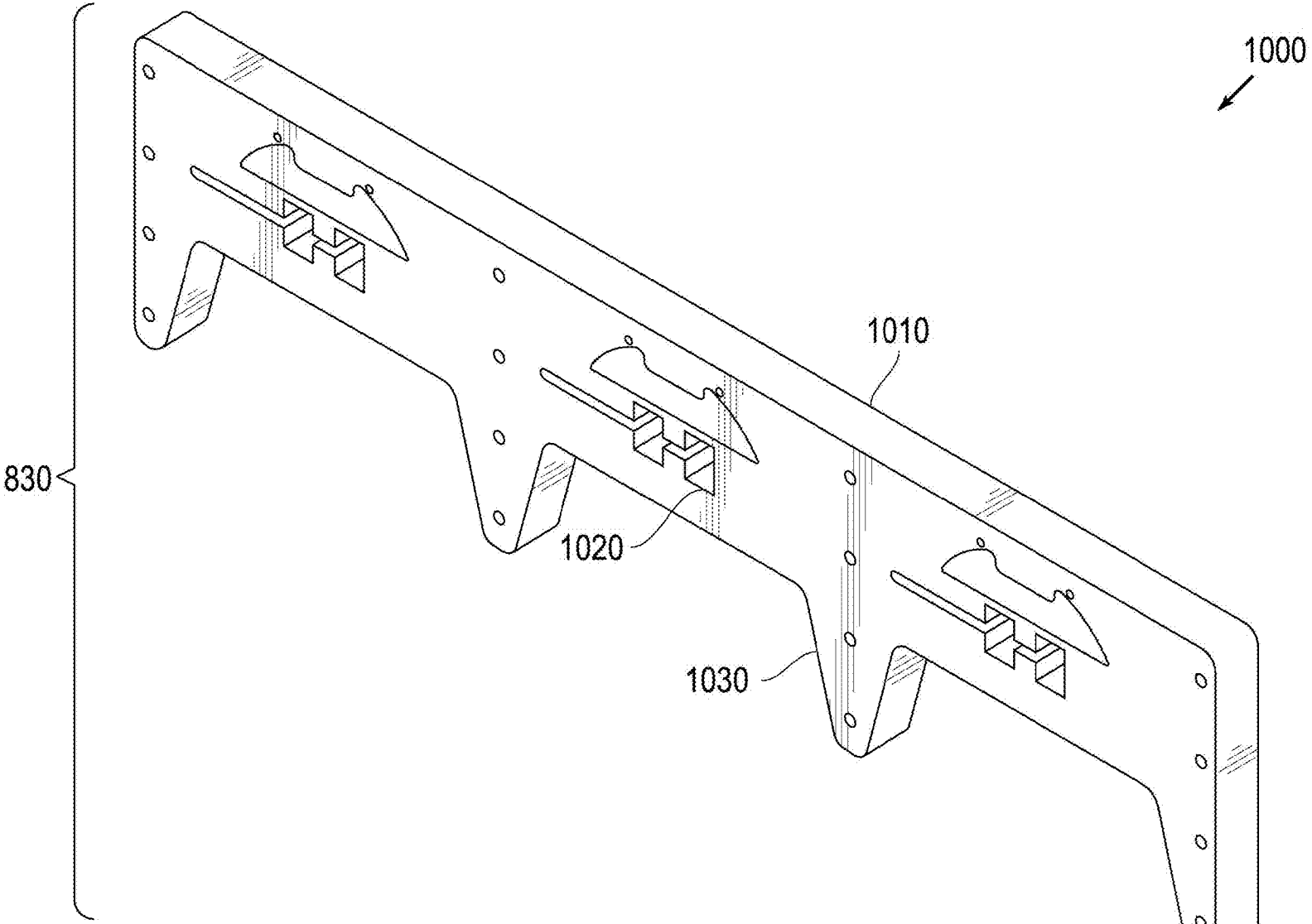
FIG. 10 is a perspective view of a back plate.

FIG. 9 shows a perspective view 900 of the platform 820 with the struts 850 as a subassembly 910. Each strut 850 includes a base 920 with an axial cavity 930 that contains the shaft hinge 855. FIG. 10 shows a perspective view 1000 of the backstop 630. A longitudinal beam 1010 includes elongated slots 1020 that include square cavities. A plurality of legs 1030 extend from the beam 910 to contact the platform 720.

No conventional launcher is designed to provide this level of modularity with such easy adjustment within each firing cell. Previously, the U.S. Navy developed a common launcher design. However like the conventional vender-supplied version, that configuration was designed and built around a specific munition or set of munitions and each cell of the launcher could only accept the munition specified.

There is definite commercial potential with this design. Conventionally, companies need to design and manufacture different launchers for each munition they build. Having a design like this one will greatly reduce their testing budget and make their company more desirable by being able to advertise to customers that only one launcher is needed for several of their munitions.

While certain features of the embodiments of the invention have been illustrated as described herein, many modifications, substitutions, changes and equivalents will now occur to those skilled in the art. It is, therefore, to be understood that the appended claims are intended to cover all such modifications and changes as fall within the true spirit of the embodiments.

What is claimed is:

1. A mounting platform for securing munitions, said platform comprising:

a flat plate having a plurality of cutouts;

a front block having a first saddle disposed between first flanking ends and at least one front extension at one of said flanking ends for inserting into a first opening of said plurality of cutouts; and a rear block having a second saddle disposed between second flanking ends and at least one rear extension for inserting into a second opening of said plurality of cutouts, wherein the munitions are disposable atop said first and second saddles.

2. The platform according to claim 1, wherein said rear block further includes a backstop to absorb munition launch recoil.

3. The platform according to claim 1, wherein said front block inserts said front extension into said first opening of said plurality of cutouts at an oblique angle and pivots to connect a front opposite end to said mounting plate, and said rear block inserts said rear extension into said second opening of said plurality of cutouts at an oblique angle and pivots to connect a rear opposite end to said mounting plate.

4. The platform according to claim 1, wherein said first and second extensions are secured into respective said openings of said plurality of cutouts by first and second bolts.

5. The platform according to claim 1, wherein the munitions are restrained axially against a rear stop block and laterally by the saddles and straps.

6. The platform according to claim 1, wherein said front block further includes a pair of Picatinny rails atop a bridge that forms said saddle.

7. A mounting platform for securing munitions, each munition stored within a canister, said platform comprising:

a flat plate having a plurality of through holes along a periphery;

a modular block having a plurality of flanges concatenated in tandem, each flange having an engaging surface that faces said mounting plate, and a saddle surface that receives the canister.

8. The mounting platform according to claim 7, wherein said modular block further includes a plurality of brace rods disposed adjacent to said engaging surface and said saddle surface to connect adjacent flanges together.

9. The mounting platform according to claim 8, further including a strap for wrapping along a selection of said brace rods and around the canister.

10. The mounting platform according to claim 8, wherein said flat plate attaches to a frame for launching the munition within the canister.

* * * * *